United States Patent [19]

Jacober

[11] Patent Number: 4,940,173

[45] **Date of Patent: * Jul. 10, 1990**

[54] BACKPACK AND INSULATED CONTAINER

[75] Inventor: Jeffrey M. Jacober, South Kingston, R.I.

[73] Assignee: SGI Inc., Cranston, R.I.

[ * ] Notice: The portion of the term of this patent subsequent to Nov. 17, 2004 has been disclaimed.

[21] Appl. No.: 239,032

[22] Filed: Aug. 29, 1988

Related U.S. Application Data

[60] Continuation of Ser. No. 59,250, Jun. 5, 1987, Pat. No. 4,767,039, which is a continuation of Ser. No. 830,522, Feb. 17, 1986, abandoned, which is a division of Ser. No. 669,862, Nov. 8, 1984, abandoned.

[51] Int. Cl.[5] ..... A45C 15/00

[52] U.S. Cl. ..... 224/151; 224/209

[58] Field of Search ..... 224/148, 153, 209, 191, 224/202, 231, 233, 235, 920

[56] References Cited

U.S. PATENT DOCUMENTS

| | | | |
|---|---|---|---|
| Re. 17,118 | 10/1928 | Granger . | |
| 2,013,358 | 9/1935 | Osborne . | |
| 2,611,519 | 9/1952 | Utterstrom . | |
| 2,857,949 | 10/1958 | Ziff . | |
| 3,233,803 | 2/1966 | Gray . | |
| 3,326,357 | 6/1967 | Miller . | |
| 3,679,108 | 7/1972 | Ingram . | |
| 3,696,850 | 10/1972 | Rosenblum . | |
| 3,705,222 | 12/1972 | Rogers et al. . | |
| 3,830,348 | 8/1974 | Ohyama . | |
| 3,980,216 | 9/1976 | Nye . | |
| 4,014,456 | 3/1977 | Echtle . | |
| 4,185,673 | 1/1980 | Daniello . | |
| 4,211,267 | 7/1980 | Skovgaard . | |
| 4,282,279 | 8/1981 | Strickland . | |
| 4,368,819 | 1/1983 | Durham . | |
| 4,375,828 | 3/1983 | Biddison . | |
| 4,513,895 | 4/1985 | Leslie . | |
| 4,533,050 | 8/1985 | Bake, Jr. . | |
| 4,537,313 | 8/1985 | Workman | 206/545 |

FOREIGN PATENT DOCUMENTS

| | | | |
|---|---|---|---|
| 1002897 | 3/1952 | France | 224/209 |
| 1308040 | 9/1962 | France | 224/209 |
| 86560 | 10/1955 | Norway | 224/209 |
| WO83/03046 | 9/1983 | PCT Int'l Appl. . | |

*Primary Examiner*—Linda J. Sholl

*Attorney, Agent, or Firm*—Lockwood, Alex, Fitzgibbon & Cummings

[57] ABSTRACT

A backpack is provided which has at least one sleeve secured to a panel of the backpack, which sleeve is sized and structured to closely receive and hold an insulated container that is readily removable from this sleeve, when desired. The insulated container includes a plurality of panels that form a container compartment, and the insulated container has a cover for selectively opening and closing a mouth of the insulated container. Walls of the insulated container are constructed in order to provide thermal insulative properties thereacross.

11 Claims, 3 Drawing Sheets

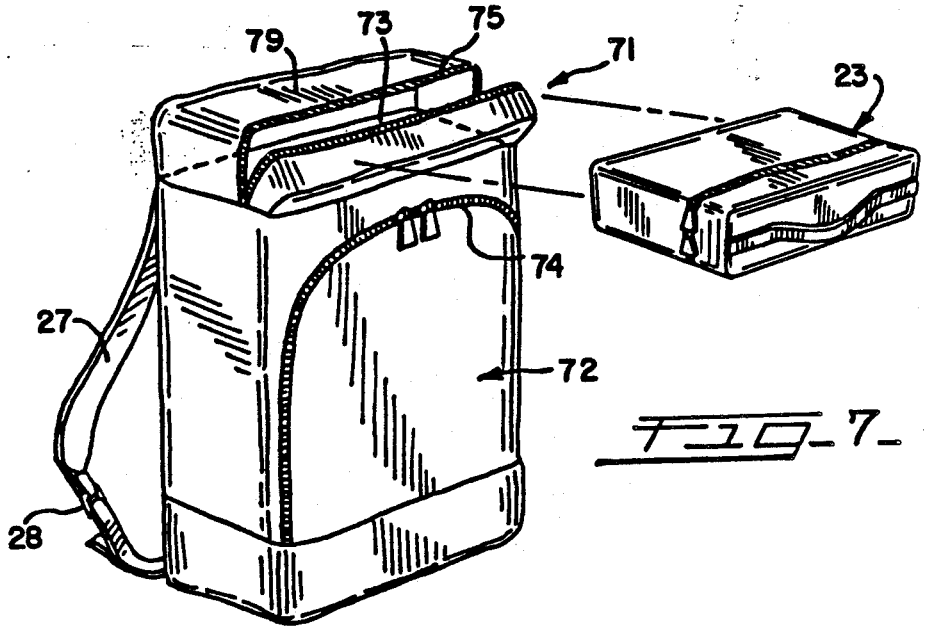
FIG. 7
FIG. 9
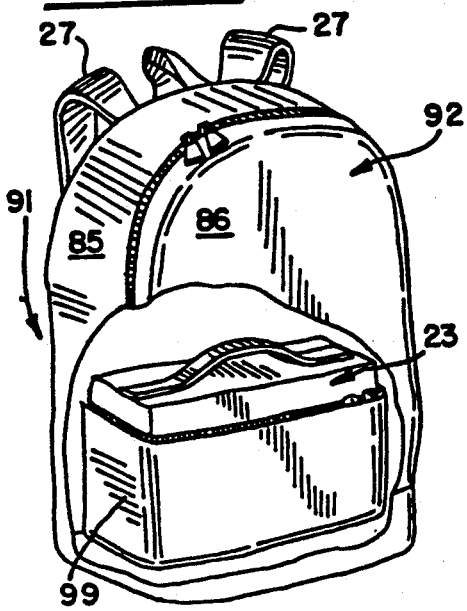
FIG. 8
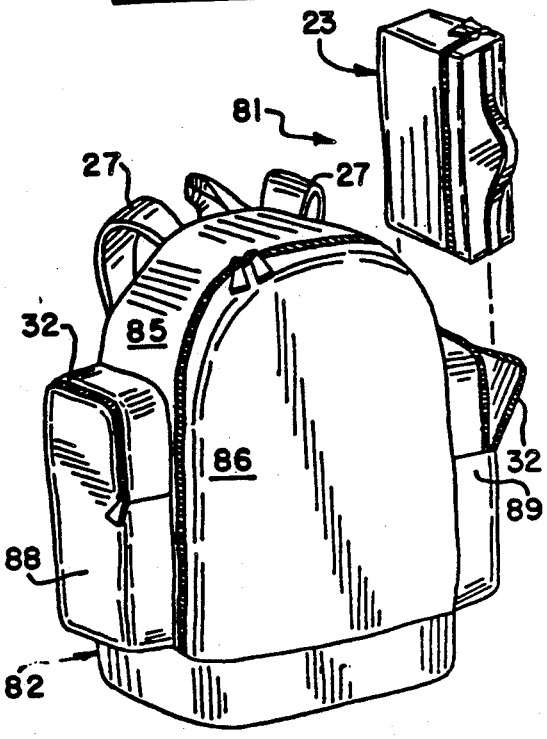

BACKPACK AND INSULATED CONTAINER

This is a continuation of application Ser. No. 059,250, filed June 5, 1987, U.S. Pat. No. 4,767,039; which is a continuation of application Ser. No. 830,522, filed Feb. 17, 1986, abandoned; which is a division of application Ser. No. 669,862, filed Nov. 8, 1984, abandoned.

BACKGROUND AND DESCRIPTION OF THE INVENTION

This invention generally relates to backpacks, more particularly to backpacks that include fabric panels that form a backpack body within which articles may be conveniently carried by means of backpack straps attached to the backpack body. In an important aspect of this invention, the backpack body has a sleeve component secured thereto, this sleeve component closely receiving and supporting an insulated container component, which insulated container component has a mouth and a cover component for selectively opening and closing the mouth.

Over the years, numerous types, sizes and styles of backpacks have been made or proposed. Such backpacks typically include panels of fabric that are secured together in order to form one or more compartments for storing and carrying various articles such as clothing, books, camping gear, sports gear and the like. For many years, users of backpacks have on numerous occasions had need for storing and transporting items which are either cooler or warmer than ambient conditions. When such occasions have arisen, the backpack user faces two principal concerns. One is that the warmer or cooler item, by virtue of the difference between its temperature and that of backpack components or contents, has a tendency to damage such backpack components or contents, for example by moisture formation within the backpack. Additionally, when such cooler or warmer items are stored and transported in an uninsulated backpack, the difference in temperature between the item being stored and the environment begins to rapidly dissipate and continues to dissipate as heat is transmitted through the panels of the backpack.

Furthermore, at times there is a desire to be able to easily and conveniently separate the warmer or cooler items as a unit from the backpack and/or any other materials positioned therewithin. Such would be the case, for example, when the warmer or cooler items comprise, for example, a meal, and it would be advantageous to be able to quickly and readily remove the cooler or warmer materials as a unit. Further advantages would be realized if this unit had insulative properties so as to enhance the storage abilities of the unit, whether within or outside of the backpack.

Advantageous results of this type have been attained, while the preceding drawbacks have been minimized, by the present invention which provides means by which a backpack is provided with a removable insulated container. The backpack and insulated container combination according to this invention includes an insulated container component having a plurality of insulated panels that are joined together and that at least substantially define a compartment having an open mouth, which open mouth is selectively openable and closable by a cover member. A backpack component made of a plurality of fabric panels defines a backpack compartment that is suitable for storing and carrying a variety of goods and gear. A sleeve component is secured to at least one of the fabric panels, which sleeve component is sized and structured in order to closely receive and hold the insulated container component in a manner such that the insulated container component is readily removable from the sleeve and from the backpack component.

It is accordingly a general object of the present invention to provide an improved backpack.

Another object of this invention is to provide an improved combination of a backpack and a removable insulated container.

Another object of the present invention is to provide an improved combination backpack and insulated container that is suitable for storing and transporting items that are cooler or warmer than ambient temperature.

Another object of the present invention is to provide a combined backpack and insulated container kit from which a unitary insulated container is easily removable.

These and other objects of the present invention will be apparent from the following description of this invention, taken in conjunction with the accompanying drawings, wherein:

FIG. 7 is a perspective, partially exploded view of yet another embodiment of the backpack with removable insulated container according to this invention;

FIG. 8 is a perspective, partially exploded view of yet a further embodiment of the backpack with removable insulated container according to this invention; and FIG. 9 is a perspective, partially cut away view of still another backpack with removable insulated container according to this invention.

Figure 1:
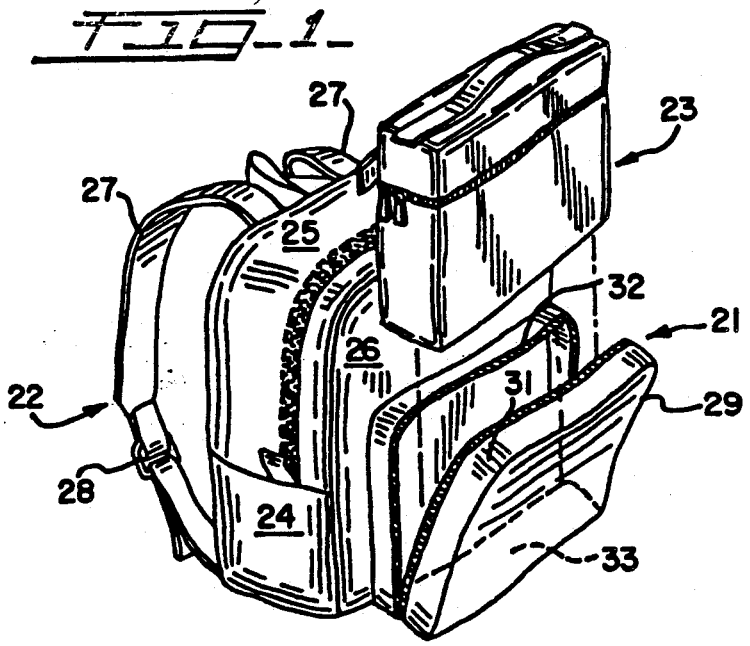
FIG. 1 is a perspective, partially exploded view of the preferred backpack with removable insulated container according to this invention.

The combined assembly according to this invention, generally designated as 21 in FIG. 1, includes a backpack component, generally designated by reference numeral 22, and an insulated container component, generally designated as 23. Backpack 22 includes a plurality of panels generally joined together along their respective edges. Included are side panels 24, a top panel 25, a back panel 26 and a front panel (hidden from view). Suitable backpack straps 27 are provided. Exemplary backpack straps 27 are the illustrated pair of straps, each having an adjustable buckle 28. The exemplified straps are each placed over a respective shoulder of the user, such that the backpack 22 is held against the back of the user in accordance with generally well-known arrangements.

In the embodiment illustrated in FIG. 1, a sleeve component 29 is secured to the back panel 26. Sleeve component 29 includes an edge panel 31 having a closure device 32 such as the illustrated zipper for selectively opening and closing the edge panel 31. Sleeve component 29 also includes a bottom 33. Insulated container 23 fits closely within the sleeve component 29 and readily passes through the closure device 32 when opened in order to thereby rest on the bottom 33. Thereafter, the closure device 32 may be closed in order to join the split portions of the edge panel 31 and thereby secure the insulated container 23 within the sleeve component 29.

Figure 2:
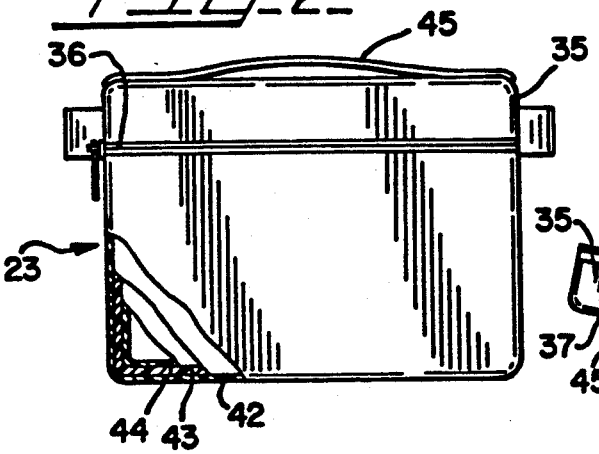
FIG. 2 is an elevational view, partially broken away, of the front of the preferred insulated container according to this invention.
Figure 3:
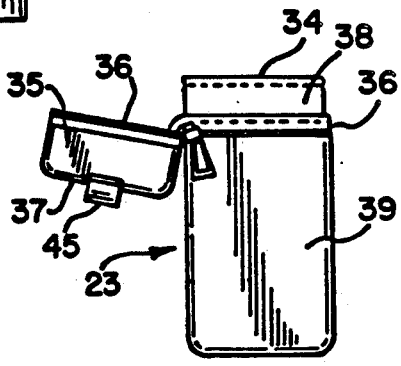
FIG. 3 is an end elevational view of the insulated container illustrated in FIG. 2, shown in an open orientation.
Figure 4:
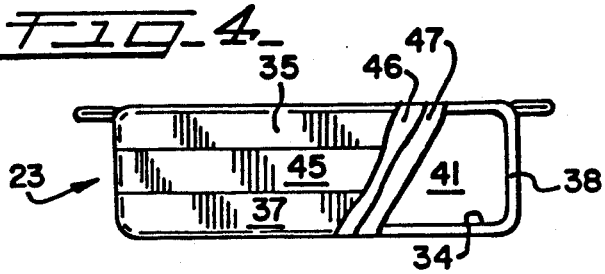
FIG. 4 is a top plan view, partially broken away, of the insulated container of FIG. 2.

Regarding the insulated container 23, such is more fully illustrated in FIGS. 2, 3 and 4. Insulated container 23 includes a mouth 34 through which access may be gained to the interior of the insulated container 23. A cover member 35 is included for selectively closing and opening the mouth 34. A closure assembly 36, such as the illustrated zipper, is provided for selectively opening and closing the mouth 34 in a manner such that the mouth 34 is completely closed by the cover member 35. Preferably, the cover member 35 has a height between the closure assembly 36 and its outside end 37, which height is adequate to have the cover 35 accommodate and enclose a lip 38 that extends beyond the closure assembly 36 on the insulated container 23. Typically, the lip 38 extends from a body 39 of the insulated container 23.

Each of the closure device 32 and the closure assembly 36 advantageously takes the form of a zipper. Other structures may be suitable, such as flaps and/or straps having ties or the like, or snaps or Velcro fasteners and the like.

Container body 39 includes a plurality of panels that are joined together generally at their respective edges so that an insulated compartment 41 having the mouth 34 is defined thereby. Suitable means are provided to impart thermally insulating properties to the compartment 41. In the preferred embodiment illustrated, wherein the insulated container 23 is substantially non-rigid, the panels of the body 39 are multi-layered. Preferably, the outside layer 42 is a synthetic or natural woven fabric that is both tough and attractive, such as Nylon, polyvinylchloride, a polyurethane, cotton, canvas, or the like. An insulator sheet 43 is positioned thereunder and made of a light-weight, thermally insulative material such as a polyolefin, for example polyethylene, a foamed polyurethane, or the like, the insulator sheet 43 often being somewhat porous. Innermost layer 44 is preferably made of a water-resistant material such as a sheet of polyolefin, polyvinylchloride, or the like.

This structure provides a body 39 that has an outside skin or layer 39 that is tough and attractive and an inside skin or layer 44 that is resistant to damage by moist, cold or warm items. Such a structure also provides a wall or insulator sheet 43 that is relatively thin yet possesses adequate insulating properties, which insulative wall or sheet 43 is protected from moisture damage by the inside skin or layer 44.

Substantially similar properties are imparted to the entire closed insulated container 23 by similarly structuring at least the outside end 37 of the cover member 35, to which a carrying handle 45 may be conveniently attached such as by sewing, energy sealing or the like. An insulator wall or sheet 46, made of a material such as that of the insulator sheet 43 of the body 39, is positioned between this outside end panel 37 and an inside panel 47, which can be made of a fabric such as the outside end 37 or of a liquid-resistant material such as that out of which the innermost layer 44 of the body portion 39 is made.

The preferred structure described herein provides an insulated container 23 that is substantially soft-walled and that is insulated across all of its outside walls. Also, by virtue of the interacting structure of the body 39 and its lip 38 on the one hand and the relatively deep cover 35 on the other hand, the means for opening and closing the insulated container 23 securely closes the container 23 in a manner by which each of the insulated panels thereof substantially fully encloses the insulated compartment 41, while at the same time providing a structure in which the cover 35, once opened as illustrated in FIG. 3, will tend to remain open and clear of the mouth 34.

Figure 5:
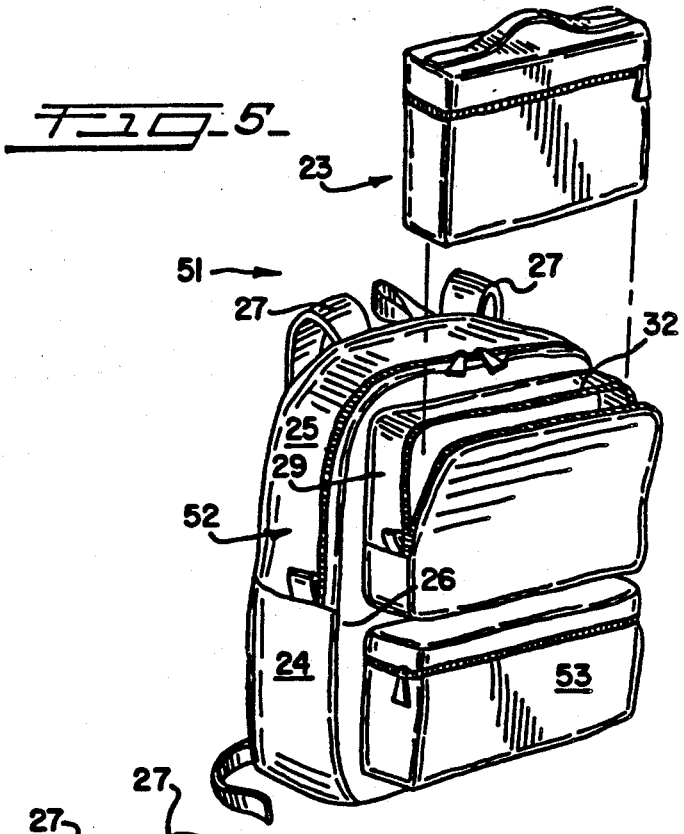
FIG. 5 is a perspective, partially exploded view of an alternative embodiment of the backpack with removable insulated container according to this invention.

In the embodiment illustrated in FIG. 5, a combined assembly, generally designated at 51, is illustrated. Combined assembly 51 includes insulated container 23 for close fit within and support by the sleeve component 29 affixed to the back panel 26 of a backpack 52, which includes a separate, additional compartment 53 located generally beneath the sleeve component 29.

Figure 6:
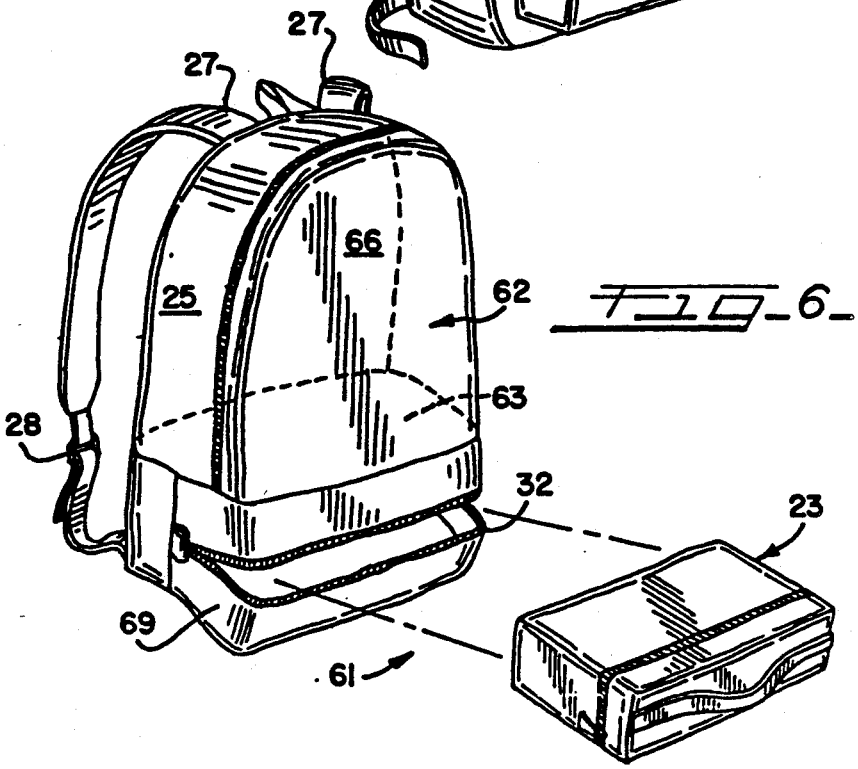
FIG. 6 is a perspective, partially exploded view of a further embodiment of the backpack with removable insulated container according to this invention.

The combined assembly of FIG. 6, generally designated as 61, includes a substantially horizontal sleeve component 69 that is generally integral with the bottom of its backpack 62. More particularly, the sleeve component 69 begins below the top panel 25 and a back panel 66, there being and internal wall 63 therebetween which separates the interior of the backpack 62 from the substantially horizontal sleeve component 69.

Regarding the combined assembly that is generally designated as 71 in FIG. 7, a backpack 72 thereof has its sleeve component 79 positioned substantially horizontally and above a top panel or internal wall 73 thereof. As is the case with all of the other embodiments, access to the internal compartment of the backpack 72 is gained by opening an appropriate closure device 74, while another closure device 75 provides selective opening and closing access into the sleeve component 79.

Combined assembly 81 illustrated in FIG. 8 includes a backpack, generally designated by reference numeral 82, which has a sleeve component 89 secured to a side panel 85 of the backpack 82 for closely holding the insulated container 23. If desired, another sleeve component 88 may be secured to the side panel 85, and the sleeve component 88 may, if desired, be provided for carrying another insulated container 23. A back panel 86 may support additional, separate compartments such as compartment 53 (FIG. 5).

In the embodiment illustrated in FIG. 9, a sleeve component 99 is secured internally of its backpack 92 in order to provide the illustrated combined assembly 91. In this embodiment, inasmuch as the sleeve component 99 is within the backpack 92, there is no need to provide means for closing the sleeve component 99.

It is to be appreciated that this invention can be embodied in various forms in addition to the several illustrated embodiments thereof. Therefore, this invention is to be construed and limited only by the scope of the appended claims.

What is claimed is:

1. A combination backpack and removable insulated container, comprising:

an insulated container component, said insulated container component including a plurality of pliable panels, said pliable panels including a bottom panel and side panels that are joined together at their respective edges into a compartment having a body and an open mouth defined by edges of the side panels, each of said panels having thermal insulation means, said insulated container component further including a pliable cover member for selectively opening and closing said open mouth;

closure means for securing said pliable cover member to said body of the insulated container, said closure means selectively joining or disjoining less than the full periphery of the cover member to the body of the insulated container component, the remainder of said full periphery of the cover member being hingedly attached to said body of the insulated container;

a backpack component, said backpack component including a plurality of pliable fabric panels that are joined together to form a pliable backpack body defining a backpack interior, said backpack body having an interior surface and an exterior surface, closure means for selectively gaining access to said interior of the backpack body; and a sleeve component secured to at least one of said fabric panels of the backpack component, said sleeve component having a mouth, and said sleeve component and its mouth are sized and structured to closely receive, hold and support said insulated container component and to permit quick and easy removal of the insulated container as a unit from said sleeve, and said sleeve component is sized for and is located on said backpack component for avoiding substantial reduction of the size of said interior of the backpack body.

2. The combination backpack and removable insulated container according to claim 1, wherein said sleeve component includes an edge panel having closure means for selectively opening and closing said edge panel and for permitting passage of said insulated container component into and out of said sleeve component.

3. The combination backpack and removable insulated container according to claim 1, wherein said sleeve component includes a bottom panel upon which said insulated container component rests.

4. The combination backpack and removable insulated container according to claim 1, wherein said cover member includes at least one insulated panel.

5. The combination backpack and removable insulated container according to claim 1, wherein said plurality of panels of the insulated container component are multi-layered and include an outside layer of woven fabric, an inside layer of water-resistant material, and an insulator sheet intermediate said outside layer and inside layer.

6. The combination backpack and removable insulated container component according to claim 1, wherein said cover member of the insulated container component includes an outside end panel that is multi-layered and includes an outside layer of woven fabric, an inside layer, and an insulator sheet intermediate of said outside layer and said inside layer.

7. The combination backpack and removable insulated container component according to claim 1, wherein said sleeve component is generally vertically mounted onto the exterior surface of a back panel of the backpack component.

8. The combination backpack and removable insulated container component according to claim 1, wherein said sleeve component is generally horizontally mounted onto a bottom panel of the backpack component that defines said backpack interior.

9. The combination backpack and removable insulated container according to claim 1, wherein said sleeve component is generally horizontally mounted onto a top panel of the backpack component that defines said backpack interior.

10. The combination backpack and removable insulated container according to claim 1, wherein said sleeve component is generally vertically mounted onto the exterior surface of a side panel of the backpack component.

11. The combination backpack and removable insulated container according to claim 1, wherein said sleeve component is generally vertically mounted onto an interior surface of the backpack component.

* * * * *